United States Patent [19]

Cobb, III et al.

[11] 4,400,677

[45] Aug. 23, 1983

[54] FAIL SAFE CIRCUIT BREAKER

[75] Inventors: Carleton M. Cobb, III, East Walpole, Mass.; Roland G. Morin, Central Falls, R.I.; Hans G. Hirsbrunner, Attleboro, Mass.

[73] Assignee: Texas Instruments Incorporated, Dallas, Tex.

[21] Appl. No.: 328,974

[22] Filed: Dec. 9, 1981

[51] Int. Cl.[3] ..... H01H 71/16; H01H 85/08

[52] U.S. Cl. ..... 337/6; 337/74

[58] Field of Search ..... 337/6, 1, 3, 4, 74, 337/77, 405

[56] References Cited

U.S. PATENT DOCUMENTS

| | | | |
|---|---|---|---|
| 3,198,914 | 8/1965 | Baran et al. | 337/405 |
| 3,361,882 | 1/1968 | Clarke | 337/74 |
| 3,796,980 | 3/1974 | Ellsworth | 337/6 |

*Primary Examiner*—Harold Broome

*Attorney, Agent, or Firm*—James P. McAndrews; John A. Haug; Melvin Sharp

[57] ABSTRACT

A circuit breaker has a thermally responsive bimetallic member of substantial resistance properties disposed in the breaker circuit so that it self-heats and moves to trip a mechanism to open the breaker circuit after a selected period of time when a selected overload current occurs in the circuit. Conductors are joined by a thermally separable bond and are disposed in the breaker circuit in selected heat transfer relation to the high resistance bimetallic member to be thermally separated after a selected delay period by heat transferred to the bond from the bimetallic means, thereby to open the circuit in the event that movement of the thermally responsive member is ineffective to open the circuit. Spring means preferably bias the conductors to separate to assure circuit opening when thermal separation of the noted bond occurs. Preferably one of the conductors has a part of reduced cross-section adapted to rupture and open the circuit under alternate circuit conditions.

5 Claims, 4 Drawing Figures

FAIL SAFE CIRCUIT BREAKER

BACKGROUND OF THE INVENTION

The field of this invention is that of electrical circuit breakers and the invention relates more particularly to thermally responsive circuit breakers for interrupting electrical circuits on the occurrence of predetermined conditions in the circuits.

Thermally responsive electrical circuit breakers typically interrupt electrical circuits in response to the occurrence of selected overload currents in the circuits to protect other equipment in the circuits from damage due to overheating or the like. In one particularly advantageous breaker shown in U.S. Pat. No. 3,361,882 commonly assigned to assignee of the present invention, a control mechanism manually moves movable contacts into and out of engagement with complementary contacts to open and close a circuit and a thermally responsive bimetallic member is operable to open the circuit in response to the occurrence of a selected overload current in the circuit. The bimetallic member is formed of metal materials having substantial electrical resistance properties and the member is disposed in the breaker circuit so that the member is self-heated and flexes to a selected extent to trip the mechanism to open the breaker circuit when a selected overload current flows in the circuit for a selected period of time. That circuit breaker has a high quality reliable structure and is adapted to be latched in open circuit position until manually reset after it has been manually opened or has been opened in response to the occurrence of an overload current. It is also "trip free" in that the circuit breaker will open in response to the occurrence of an overload current even if the manual resetting means is manually held in the circuit closing position.

However, for some applications it would be highly desirable for such a circuit breaker to be characterized by additional backup features to assure fail safe operation and to open the breaker circuit on the occurrence of an overload condition even if the described control mechanism should fail to operate or should be otherwise ineffective to separate the breaker contacts. It would also be desirable to achieve such fail safe operation at low cost without reducing the sturdiness and reliability of the breaker and while permitting the breaker to incorporate other known features and operating characteristics.

SUMMARY OF THE INVENTION

It is an object of this invention to provide a novel and improved thermally responsive electrical circuit breaker; to provide such a circuit breaker having thermally responsive bimetallic means adapted to be heated and flexed in response to the occurrence of an overload current in the breaker circuit for tripping a mechanism to open the breaker circuit; to provide such a circuit breaker adapted to assure opening of the breaker circuit on the occurrence of an overload current even if heating and flexing of the thermally responsive bimetallic member should be ineffective for opening the circuit; and to provide such circuit breaker having a reliable and inexpensive structure.

Briefly described, the novel and improved circuit breaker of this invention comprises movable contact means, complementary contact means, and a control mechanism for normally holding the movable contact means in engagement with the complementary contact means in a closed circuit position. The control mechanism includes a thermally responsive bimetallic member having substantial electrical resistance properties which is disposed in the breaker circuit so that an overload current flowing in the circuit for a selected period of time self-heats the bimetallic member causing it to flex and trip the mechanism to open the breaker circuit in any conventional manner. In accordance with this invention, conductor means such as a pair of thermally and electrically conductive metal strips are joined together by a thermally separable solder bond or the like and are disposed in the breaker circuit so that the thermally separable bond is in selected heat-transfer relation to the self-heated thermally responsive bimetallic member. The bond is arranged so that it is adapted to separate after a second delay period in response to heat transfer to the bond from the bimetallic member in the event that the breaker circuit is not opened in response to movement of the bimetallic member after said first period of time. In that arrangement, the thermally separable bond is initially shielded from bond separating temperatures by opening of the breaker circuit when normal circuit breaker operation occurs but is adapted to backup that normal operation to open the circuit in the event that normal circuit breaker operation fails to occur. Preferably, one of the conductor strips extends for a selected distance from the bimetallic member to the thermally separable bond to provide controlled heat-transfer to the bond for assuring that sufficient heat is conducted to the bond to thermally separate the bond to open the circuit after the desired second selected period of time. Preferably, spring means are also arranged for normally biasing the pair of conductive metal strips to separate for assuring that the circuit is opened if thermal separation of the bond occurs. Preferably one of the conductors has a part of reduced cross-section adapted to rupture and open the circuit under alternate circuit conditions.

In that arrangement, it can be seen that the circuit breaker mechanism is adapted to include any of a variety of conventional operating features such as manual operation, ambient compensation, and trip-free operation and the like. It also includes the reliable thermally responsive bimetallic means which are well known and widely accepted for use in regulating circuit breaker operation. In addition, the circuit breaker uses the heat generated by the conventional thermally responsive member for thermally separating a bond when necessary to provide fail-safe opening of the breaker circuit in the event that the circuit is not open by movement of the bimetallic member in the normal manner. The thermally separable bond is typically shielded from load separating temperature during normal circuit breaker operation so that the thermally separable bond has a long service life. However, it provides assured backup opening of the circuit when required.

DESCRIPTION OF THE DRAWINGS

Other objects, advantages and details of the novel and improved thermally responsive circuit breaker of this invention appear in the following detailed description of preferred embodiment of the invention, the detailed description referring to the drawings in which.

DESCRIPTION OF THE PREFERRED EMBODIMENTS

Figure 1:
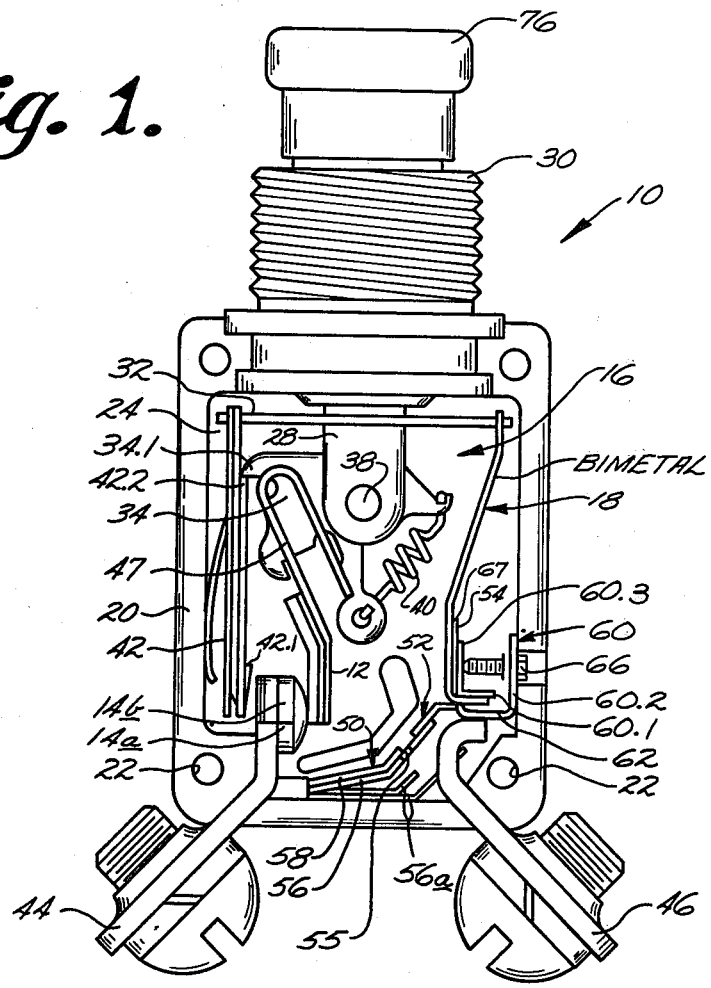
FIG. 1 is a side elevation view of the circuit breaker of this invention.
Figure 2:
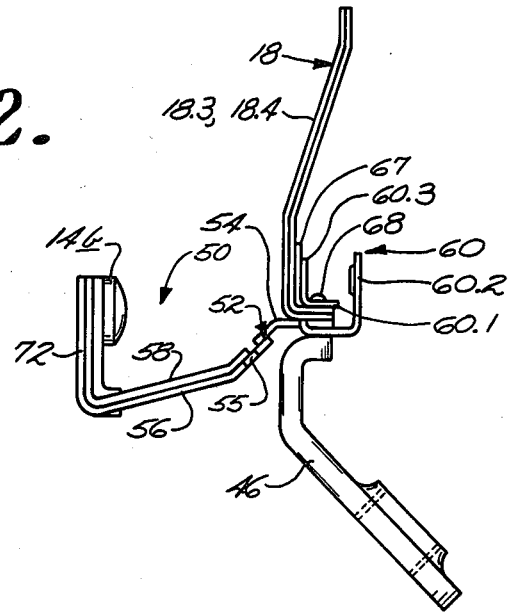
FIG. 2 is a partial side elevation similar to FIG. 1 to enlarged scale illustrating the thermally responsive bimetallic member assembly used in the circuit breaker of FIG. 1.

Referring to the drawings, 10 in FIG. 1 indicates the novel and improved thermally responsive circuit breaker of this invention which is shown to include movable contact means 12, complementary contact means 14, and a control mechanism 16, the control mechanism including thermally responsive bimetallic means 18. The control mechanism normally holds the movable contact means 12 in engagement with the complementary contact means 14 to close the breaker circuit. However, the thermally responsive bimetallic means 18 has substantial electrical resistance properties and is disposed in the breaker circuit where it is adapted to be self-heated and to flex to a predetermined extent in response to the flow of a selected overload current in the breaker circuit for a first selected period of time. When the thermally responsive bimetallic means flexes to that extent, it is adapted to trip the mechanism 16 to move the movable contact means out of engagement with the complementary contact means to open the breaker circuit in a conventional manner. In the preferred embodiment of the circuit breaker 10 according to this invention, the control mechanism 16 is also adatped to manually move the movable contacts into and out of engagement with the complementary contacts, to releasably latch the movable contact means in open circuit position when they are moved to that position either manually or in response to the occurrence of an overload current, to permit the breaker circuit to be manually reset after manual opening or after normal opening in response to overload currents if the bimetallic means have cooled, to be compensated for variations in ambient temperature in its normal thermal response to the occurrence of an overload current in the breaker circuit, and to be trip-free.

As thus far described, the circuit breaker 10 substantially corresponds to the circuit breaker illustrated in U.S. Pat. No. 3,361,882 the disclosure of which hereby incorporated herein by this reference. That is, the circuit breaker includes a pair of mating casing halves 20 (only one being shown in FIG. 1) which are secured together by screws (not shown) extending through the casing apertures 22 to form an enclosure or chamber 24 therebetween, the casing halves having grooves and abutments therein for locating the various breaker components in the chamber or on the casing halves as will be understood. A push-pull button 26 and an operating member 28 are mounted in a bushing 30 which is held between the casing halves, the bushing threads serving to mount the breaker on a control panel or the like so that the push-pull button is accessible on the panel as will be understood. The operating member 28 extends into the chamber 24 and through an aperture (not shown) in a motion transfer member 32 so that a bell crank 34 and an anchor plate 36 are rotatable in a bifurcated end of the operating member on a shaft 38. A spring 40 biases the bell crank to rotate in a counter clockwise direction as viewed in FIG. 1 and a latch 42 pivotable in slots 42.1 in the casing halves has a latch end 42.2 normally engaged with a latch nose 34.1 on the bell crank. The complementary contact means 14 comprise a first complementary contact **14*a* connected to one terminal 44 and a second complementary contact 14*b* which is electrically connected to a terminal 46 through the bimetallic means 18. The movable contact means 12 are mounted on the bell crank 34 by spring means 47 and are adapted to be moved into and out of resilient, bridging engagement with the two complementary contacts 14 for closing and opening the breaker circuit. The motion transfer member is movable with the bimetallic member 18 for moving the latch 42 as the bimetallic member moves, and additional latch and spring means (not shown) are incorporated within the bushing 30**.

As the structure thus far described is shown in U.S. Pat. No. 3,361,882, it is not further described herein and it will be understood that, if the push-pull button 26 is manually depressed when the breaker circuit is open and when the bimetallic member 18 is cold, the bimetallic member 18, the motion transfer member 32, and the latch 42 are in the position as shown in FIG. 1, the latch being biased by a spring part 42.3 to pivot to the right in the casing slots 42.1 as viewed in FIG. 1. Accordingly, the operating member 28 moves the bell crank 34 downwardly to engage the nose 34.1 with the latch end 42.2 and to rotate the bell crank clockwise against the bias of the spring 40 to engage the movable contact means 12 with the complementary contact means 14 to close the breaker circuit between the terminals 44 and 46. The releasable latch and spring means (not shown) within the bushing 30 resiliently hold the bell crank in the position shown while the breaker contacts are in the illustrated closed circuit position. In that arrangement, the breaker circuit extends from the terminal 44 through the contacts 12 and 14 and via the bimetallic member 18 to the terminal 46. Pulling on the button 26 is effective to release the latch means (not shown) within the bushing 30 so that the bell crank 34 rotates counterclockwise to disengage the movable contacts 12 from the complementary contacts 14 to open the breaker circuit and to move the push button 26 outwardly from the bushing 30.

Further, if an overload current occurs in the breaker circuit, that current flows through the thermally responsive member 18 as will be described more fully below. The bimetallic member is formed of metal materials having substantial electrical resistance properties in the normal manner of thermally responsive bimetal members. As a result, the member tends to be self-heated and to flex (to the left as viewed in FIG. 1) in response to such self-heating. The bimetallic member is proportioned in conventional manner so that, when a selected overload current continues for a first period of toime, the bimetallic member flexes sufficiently to move the transfer member 32 to unlatch the latch end 42.2 from the bell crank nose 34.1. When that occurs, the bell crank rotates counterclockwise under bias of the spring 40 moving the contacts 12 to open circuit position and releasing the resilient pressure on the releasable latch means (not shown) within the bushing 30, whereby the spring means (not shown) in the bushing 30 move the push-pull button 26 and the operating member 28 to their open circuit positions. The latch end 42.2 is mounted on the latch 42 by thermally responsive means which compensate for changes in ambient temperate so that the above-described opening of the breaker circuit occurs after the occurrence of the selected overload current for the selected first period of time even under varying ambient temperature conditions.

In accordance with this invention, complementary contact 14*b* is electrically connected to the bimetallic member 18 by conductor means 50 which incorporate a thermally separable bond 52 of selected characteristics. The thermally separable bond is disposed in selected heat-transfer relation to the thermally responsive bimetallic member 18 so that, when the member is self-heated in response to the occurrence of said selected overload current in the breaker circuit, heat from the bimetallic member tends to be transferred to the bond. The bond is located and proportioned so that, when the bimetallic member is adapted to be self-heated and to flex to open the breaker circuit in response to the occurrence of the selected overload current for a selected first period of time, the bond 52 is not thermally separated by the heat transferred to the bond before the breaker circuit opens and the opening of the circuit effectively shields the bond from further heating. The bond therefore retains its full strength during normal operation of the circuit breaker as the circuit breaker opens in response to overload currents in the breaker circuit. However, the bond 52 is located and proportioned so that, if normal circuit breaking operation of the breaker should fail so that self-heating and/or flexing of the thermally responsive bimetallic member 18 is ineffective to open the breaker contacts, heat-transfer from the member 18 to the bond 52 continues and is subsequently effective after a selected second, relatively longer period of time, to thermally separate the bond 52 so that the breaker circuit is open by separation of the conductor means 50. Typically for example, where the circuit breaker is adapted to open in 0.25 seconds in response to a selected overload current of 50 amperes in response to flexing movement of the member 18, the thermally separable bond 52 is adapted to separate in about 3.5 seconds in response to the occurrence of the same overload current. In that way, the breaker provides fail-safe protection for the equipment being protected from overload currents by the circuit breaker 10.

Preferably for example, the conductor means 50 comprises a pair of thin, electrically and thermally conductive metal strips 54 and 56 which are soldered together to form the thermally separable bond 52. In a typical embodiment of this invention, one or both of the conductive strips 54 and 56 have spring properties and the strips are biased to move apart and to separate when thermal suspension of the bond 52 occurs. In that way, the spring properties of the strip assure opening of the circuit. In the preferred embodiment of this invention however, the conductive strips 54 and 56 are formed of thin easily bendable strips of thermally and electrically conductive metal material such as copper or brass and a spring blade 58 of steel or phospher bronze or the like is arranged to bias the strip 56 to move away from the strip 54 to open the breaker circuit if thermal separation of the bond 52 occurs. The thermally separable bond 52 is preferably formed by soldering the strips 54 and 56 together using a 97.5/1.5/1.0% by weight solder alloy of lead-silver-tin and copper having an initial melt temperature of 309° C. or the like. In the preferred device, strip 56 has notches 55 providing the strip with a selected reduced cross-section so the strip is adapted to rupture and additionally open the breaker circuit within a selected third period of time relatively longer than the first period and shorter than the second period if a selected very high overload current should occur (e.g. as a result of a direct short circuit) and the breaker has been otherwise ineffective to separate the breaker contacts.

Figure 3:
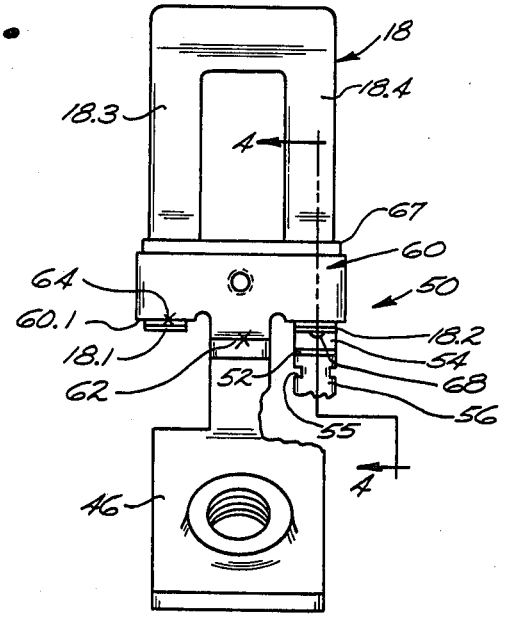
FIG. 3 is an end elevation view of the bimetallic member assembly shown in FIG. 2.
Figure 4:
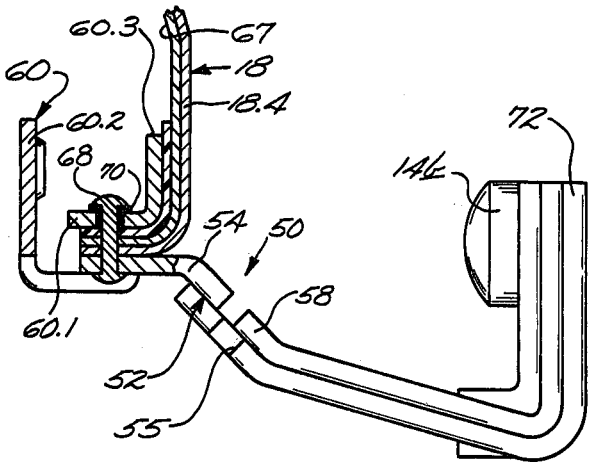
FIG. 4 is a section view along line 4—4 of FIG. 3.

In a preferred embodiment of this invention as shown in FIGS. 1–4 for example, the bimetallic member 18 has a generally U-shaped configuration as is best seen in FIG. 3 and has tang parts 18.1 and 18.2 at the ends of the respective legs 18.3 and 18.4 of the U-shape. A channel shape bracket 60 is welded as at 62 to the terminal 46 and one of the bimetallic member tangs 18.1 is welded to the bottom 60.1 of the bracket at one end of the bracket as indicated at 64 in FIG. 3. An adjusting screw 66 is threadedly engaged in the bracket flange 60.2 and is adapted to be rotated in the flange to apply a force to the bracket flange 60.3 for adjusting the disposition of the bimetallic member legs relative to the bracket for calibrating the circuit breaker 10 in conventional manner. An electrically insulating film 67 is fitted between the bracket flange 60.3 and the member legs 18.3 and 18.4. The conductive metal strip 54 is then connected to the other tang 18.2 of the bimetallic member by a rivet 68 but is electrically insulated from the bracket at that location by the bushing 70 fitted around the rivet. The strip 54 is mounted so that it extends toward the complementary contact 14*b*. The spring blade 58 is provided with a suitable aperture to fit over a weld projection and the conductive metal strip 56 is welded to the projection on the back side of the complementary contact 14*b* so that the spring and the strip 56 are secured to the contact 14*b*. The spring blade is selected to have a generally flat or straight configuration or the like so that when it is mounted to bend around a part of the contact 14*b* as shown to extend along the strip 56 toward the bimetallic member 18, the spring biases the strip 56 to separate and move away from the strip 54. In that arrangement, the breaker circuit extends from the complementary contact 14*b* through the strips 56 and 54 to one end of the bimetallic member 18 and then extends through the full length of the U-shape of the bimetallic member to the bracket 60 and to the terminal 46. The U-shape of the member 18 is selected and the material of the member 18 is provided with substantial electrical resistance properties of about 675 ohms/cir. mil foot or the like for providing the member with substantial self-heating properties. The conductive metal strip is provided with a selected length and selected heat-conducting properties. Accordingly, the thermally separable bond 52 is located at a desired distance from a bimetallic member 18 having selected self-heating properties so that, when selected overload current occurs, the thermally separable bond 52 is initially shielded to a substantial extent from the heating effect of the bimetallic member 18 by the length of the metal strip 54. As a result, if the breaker circuit is opened in the normal manner so that further self-heating of the bimetallic member is terminated, the thermally separable bond is not subjected to weakening temperatures. However, if the normal opening of the circuit breaker does not occur, the bond 52 is rapidly and assuredly heated and separated by heat transferred from the member 18 through the strip 54. When that bond separation occurs, the spring 58 rapidly moves the bendable strip 56 to the position shown in dotted (56*a*) lines in FIG. 1 to open the breaker circuit. The spring retains the strip 56 in that circuit opening position and the breaker circuit cannot be reclosed. Thus, the circuit breaker is provided with fail-safe operating characteristics at very limited cost and without otherwise interferring with the normal operating functions of the circuit breaker. Where the conductor strip 56 has a reduced cross section 55 as noted above, the circuit breaker even provides back up fail safe operation for direct short circuit conditions and the like.

It should be understood that although particular embodiments of the circuit breaker of this invention have been described by way of illustrating the invention, this invention includes all modifications and equivalents of the disclosed embodiments falling within the scope of the appended claims.

We claim:

1. A circuit breaker comprising movable contact means, complementary contact means, a mechanism for holding the movable contact means in engagement with the complementary contact means to close an electrical circuit, the mechanism including thermally responsive bimetallic means of relatively high resistance properties disposed in the circuit to generate heat and be self-heated within a first selected period of time in response to the flow of a selected overload current in the circuit through the bimetallic means to trip the mechanism to move the movable contacts to open the circuit, and thermally separable means in the circuit for alternately opening the breaker circuit, characterized in that, said thermally separable means comprises conductor means joined by a thermally separable bond and disposed in the circuit in a heat-transfer relation to the bimetallic means selected so that the conductor means are thermally separated after a second period of time by heat generated in the bimetallic means and transferred to the conductor means from the bimetallic means when said selected overload current flows in the circuit to open the circuit after said second period of time in the event that heating of the bimetallic means is ineffective to move the movable contact means to open the circuit after said first period of time.

2. A circuit breaker as set forth in claim 1 further characterized in that the conductor means comprises a pair of thermally and electrically conductive metal strips having overlapping ends thereof soldered together to form said thermally separable bond means, and one of the conductive strips extends for a distance in heat-conducting relation from the bimetallic means to the thermally separable bond means selected to thermally separate the strips to open the circuit after said second selected period of time but otherwise avoid overheating of the bond to permit the thermally separable bond means to maintain substantial strength through repeated thermal cycles of the circuit breaker wherein the circuit is repeatedly opened by movement of the movable contact means and the response to the occurrence of said selected overload current in the circuit.

3. A circuit breaker as set forth in claim 1 further characterized in that the conductive strips are formed of a material of high thermal conductivity selected from the group consisting of copper and brass disposed in said circuit and separate spring means resiliently bias the conductor means to separate the bond means for assuring opening of the circuit on the occurrence of thermal separating of the bond means.

4. A circuit breaker comprising movable contact means, and a mechanism for holding the movable contact means in engagement with the complementary contact means to close an electrical circuit, the mechanism including thermally responsive bimetallic means of relatively high resistance properties disposed in the circuit to be self-heated within a first selected period of time in response to the flow of a selected overload current in the circuit through the bimetallic means to trip the mechanism to move the movable contacts to open the circuit, characterized in that, conductor means are joined by a thermally separable bond and are disposed in the circuit in selected heat-transfer relation to the bimetallic means to be thermally separated after a second period of time by heat transferred thereto from the bimetallic means when said selected overload current flows in the circuit to open the circuit after said second period of time in the event that heating of the bimetallic means is ineffective to move the movable contact means to open the circuit after said first period of time, one end of the thermally responsive bimetallic means is secured in a fixed position relative to the complementary contact means, a pair of conductive metal strips have overlapping ends thereof soldered together to form said thermally separable bond means, one of the strip means extends in a selected direction from said one end of the bimetallic means toward the complementary contact means and the other strip means extends to and is electrically connected to the complementary contact means, and spring means extend along the second strip biasing the second strip means to separate for assuring opening of the circuit on the occurrence of thermal separation of the strip means.

5. A circuit breaker as set forth in claim 4 wherein the second strip has a portion of selected reduced cross-section such that the strip will rupture and open the breaker circuit within a selected third period of time relatively longer than said first period and shorter than said second period if a selected relatively very high overload current should occur in the breaker circuit and the heater was otherwise been ineffective to separate the breaker contacts.

* * * * *